US005782626A

United States Patent [19]

Joos et al.

[11] Patent Number: 5,782,626

[45] Date of Patent: Jul. 21, 1998

[54] AIRBLAST ATOMIZER NOZZLE

[75] Inventors: Franz Joos, Weilheim, Germany; Marcel Stalder, Untersiggenthal, Switzerland

[73] Assignee: Asea Brown Boveri AG, Baden, Switzerland

[21] Appl. No.: 696,665

[22] Filed: Aug. 14, 1996

[30] Foreign Application Priority Data

Oct. 21, 1995 [DE] Germany ..... 195 39 246.9

[51] Int. Cl.[6] ..... F23D 7/00

[52] U.S. Cl. ..... 431/8; 431/2; 431/181; 431/187; 431/183

[58] Field of Search ..... 431/8, 2, 181, 431/187, 189, 182, 183, 184; 239/400, 419, 420, 422, 423, 424, 424.5, 425, 404, 403, 416, 434, 433; 60/748, 743

[56] References Cited

U.S. PATENT DOCUMENTS

| | | | |
|---|---|---|---|
| 1,737,945 | 12/1929 | Rigby | 239/419 |
| 3,853,273 | 12/1974 | Bahr et al. | 60/748 |
| 3,961,475 | 6/1976 | Wood | 60/743 |
| 4,284,239 | 8/1981 | Ikeuchi | 239/419.3 |
| 4,726,760 | 2/1988 | Skoog | 431/8 |
| 5,199,355 | 4/1993 | Larue | 431/189 |
| 5,573,392 | 11/1996 | Paikert et al. | 431/9 |

FOREIGN PATENT DOCUMENTS

| | | |
|---|---|---|
| 2060401 | 6/1971 | Germany . |
| 2820702 | 11/1978 | Germany . |
| 3043698A1 | 6/1981 | Germany . |
| 3642122C1 | 6/1988 | Germany . |
| 2175993 | 12/1986 | United Kingdom . |
| WO94/29647 | 12/1994 | WIPO . |

OTHER PUBLICATIONS

"Brennkammer, insbesondere fur Reaktionsantriebe", Reg. 2264, Dornier GmbH, Apr. 1970.

"Airblast Atomization", Lefebvre, *Prog. Energy Combust. Sci.*, vol. 6, pp. 233–261 (1980).

*Primary Examiner*—Carl D. Price

*Attorney, Agent, or Firm*—Burns, Doane, Swecker & Mathis, L.L.P.

[57] ABSTRACT

In an airblast atomizer nozzle (2) for the operation of a burner (1) operated with liquid and gaseous fuels (4, 6) the intermediate wall (18) between the inner (14) and outer (13) air duct is held via inner and outer support elements (21) which have a sliding fit (28) and which can be designed as swirl vanes. The atomizer edges (19) of the airblast nozzle (2) are angled in the direction of the nozzle axis (11). The nozzle is distinguished by small dimensions, a low pressure loss and a negligible tendency to coking.

14 Claims, 6 Drawing Sheets

AIRBLAST ATOMIZER NOZZLE

FIELD OF THE INVENTION

The invention relates to the field of combustion technology. It is concerned with an atomizer nozzle for the atomization of liquid fuel in a burner, which atomizer nozzle works on the airblast principle, is suitable for operating the burner both with liquid and with gaseous fuels and can be used, in particular, in low-pollutant premixing burners of the double cone type.

BACKGROUND

For low-pollutant premixing combustion, prior to combustion the fuel must be mixed as homogeneously as possible with the combustion air. If liquid fuel is used, this must be previously atomized. In this case, the liquid fuel jet is split up into individual droplets, so that the fuel acquires as large an evaporation surface as possible.

For atomizing liquid fuels in combustion chambers, inter alia so-called airblast atomizers are also used (see A. H. Lefebvre, Airblast Atomization, Prog. Energy Combust. Sci. Vol. 6, p. 233–261, 1980), these being suitable particularly for the operation of gas turbines. These airblast atomizers are designed in such a way that the relatively slowly moving liquid fuel is atomized by an air stream of high velocity. The fuel has, in this case, no inherent momentum. The liquid to be atomized is applied, for example as a thin film of approximately constant thickness, to an atomizer edge. This atomizer edge has an air stream flowing round on both sides, that is to say an outer and an inner air stream, the atomization of the liquid fuel then taking place at the atomizer lip in the shear field of the two air streams (prefilming atomization).

As is known, in this case, the liquid fuel is applied either via central pressure atomizers or via so-called film-laying devices which are integrated in the forward flow of the atomizer edge in this component and which therefore necessitate a relatively thick component.

In order to guide the air onto the atomizer edge in a controlled manner, the inner air stream is either swirled and/or guided outward via a central body.

A disadvantage of this known prior art is a relatively large component diameter or the high pressure drop in the nozzle on account of the narrow cross section.

In general, the nozzle diameter becomes relatively large as a result of the swirling of the inner air stream. To remedy this, therefore, the airblast atomizer is designed with a displacement body. The disadvantage of this displacement body is that it gives rise to an increased susceptibility to the formation of coke and gum in the downstream section. In addition, owing to the proximity to the flame, the cooling of this part is, as a rule, a problem which is difficult to solve.

SUMMARY OF THE INVENTION

The invention attempts to avoid all these disadvantages. It is based on the object of developing an airblast nozzle for the atomization of liquid fuels, which can also be used for gas operation and which is distinguished by small dimensions and is therefore highly suitable, for example, for use in a premixing burner of the double cone type, the nozzle being distinguished by reduced susceptibility to coking and to the formation of gum. Furthermore, only a minor pressure loss is to occur in the nozzle. Finally, the object of the invention is to propose a mechanism, by means of which it is possible to throttle the atomizer air during gas operation and proportion the required atomizer air during operation with a liquid fuel.

In an airblast nozzle according to the invention, this is achieved, in that the intermediate wall between the inner and the outer air duct is held via inner and outer support elements, the inner support elements being arranged between the intermediate wall and the fuel pipe and the outer support elements being arranged between the intermediate wall and the nozzle outer body, and in that the atomizer edges are angled in the direction of the nozzle axis.

The advantages of the invention are the compact design of the airblast nozzle and its minimal diameter, so that it can be used effectively particularly in a premixing burner of the double cone type. A further advantage arises from the fact that components tending to deposits or overheating no longer have to be arranged at the nozzle outlet. Moreover, only a minor pressure loss occurs in the nozzle and the design-based pressure drop is at the atomizer lip.

It is particularly expedient if the liquid fuel pipe is axially displaceable, whilst the nozzle outer body is an integral part of the burner and is thus firmly fixed, the sliding point being provided between the inner supports on the liquid fuel pipe and the intermediate wall between the inner and the outer air duct. The thermal expansion of the lance pipe is thus absorbed via the displacement of the oil film sprayer. The position of the atomizer edge relative to the burner consequently remains unchanged. A further advantage is that the problematic sealing between the pilot gas conduit and the atomizer becomes unnecessary, because, here, the outer atomizer part is an integral part of the burner. Finally, a further advantage is that, during the assembly of the fuel lance, the sensitive atomizer part can remain in the burner and is therefore not damaged.

It is also possible, as an embodiment, to leave the atomizer as a whole and to slide it outside.

Finally, the fuel is advantageously applied via commercially available pressure atomizers, particularly hollow-cone atomizers. To apply the fuel, simple bores, which are made radially or obliquely at the closed end of the fuel conduit, are also suitable. It is advantageous, here, if the fuel film is equalized via weirs additionally arranged in the atomizer edge.

It is advantageous, furthermore, if the inner and/or outer support elements are designed as swirl vanes. The swirling of the air achieves better atomization. At the same time, the swirling of the inner air stream serves for a better flow around the. atomizer lip, whilst the outer swirling influences the spray angle $\alpha$. Fuel application can also take place in a swirled manner (radially or obliquely relative to the nozzle axis).

Finally, in a method for operating the airblast nozzle according to the invention, in the case of operation with gaseous fuel the inflow of air into the burner interior being at least partially throttled, it is advantageous that throttling takes place as a result of the different thermal expansion of the liquid fuel pipe during gas or oil operation. This throttling mechanism can be implemented in a very simple way.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings which represent several exemplary embodiments of the invention and wherein.

Figure 1:
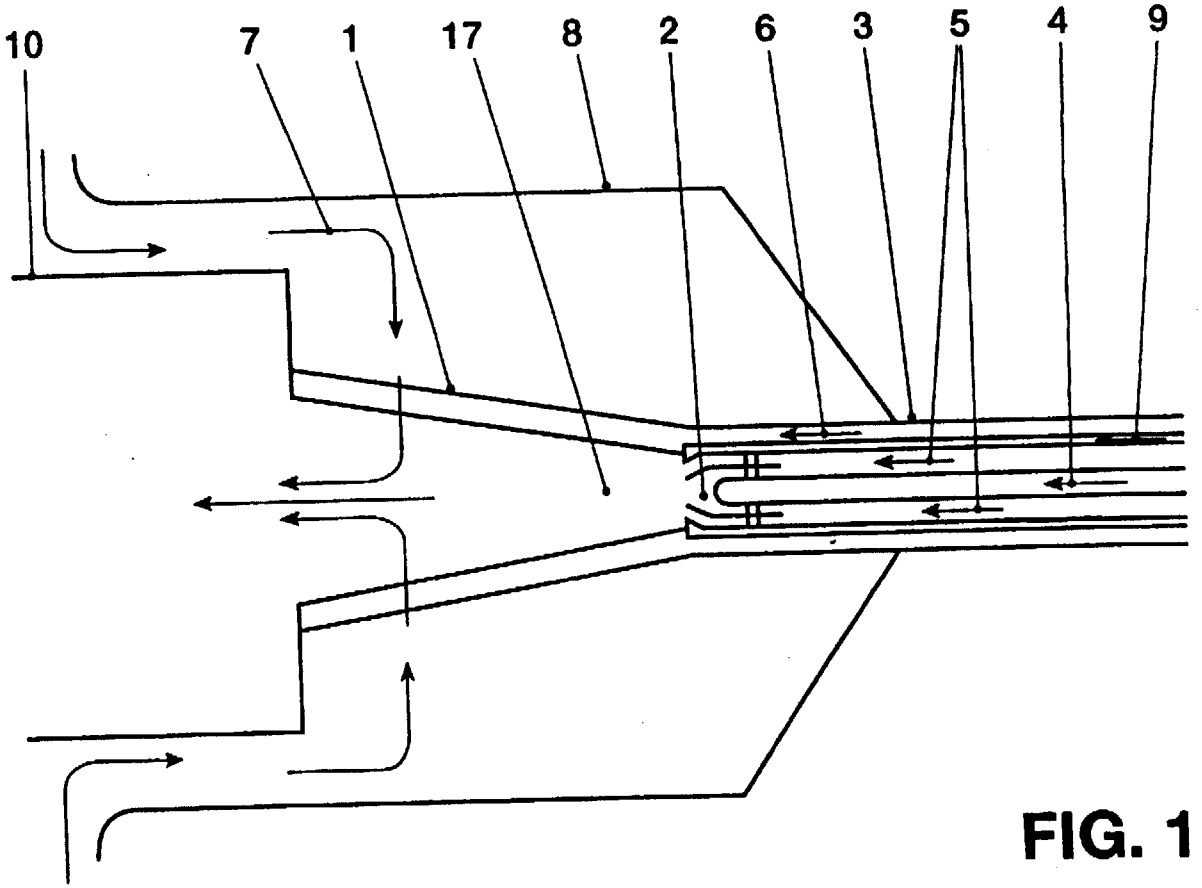
FIG. 1 shows a diagrammatic representation of the arrangement of a double cone burner equipped with an airblast nozzle.

Only the elements essential for understanding the invention are shown. The direction of flow of the working media is designated by arrows.

DESCRIPTION OF THE PREFERRED EMBODIMENTS

Referring now to the drawings, wherein like reference numerals designate identical or corresponding parts throughout the several views, the invention is explained in more detail below by means of exemplary embodiments and FIGS. 1 to 7.

FIG. 1 shows a diagrammatic representation of the arrangement of a premixing burner of the double cone type equipped with an airblast nozzle.

Arranged in the upstream end of the burner 1 is an airblast nozzle 2. It is supplied, via a fuel lance 3 connected to the double cone burner 1, with liquid fuel 4 and compressed air 5 which is used for atomizing the fuel 4. Moreover, the fuel lance 3 delivers the gaseous fuel 6 for the double cone burner 1, whilst the latter receives its main burner air 7 from the space within the burner hood 8. The air 5 for the airblast nozzle 2 can also be fed from a plenum chamber (not shown) located outside the burner hood 8. Moreover, in this exemplary embodiment, in order to enrich the fuel gases, additional gaseous fuel (pilot gas 9) is injected into the burner 1 in the vicinity of the axis of the double cone burner 1 via the fuel lance 3. The burner 1 opens into the combustion chamber 10 downstream.

Figure 2:
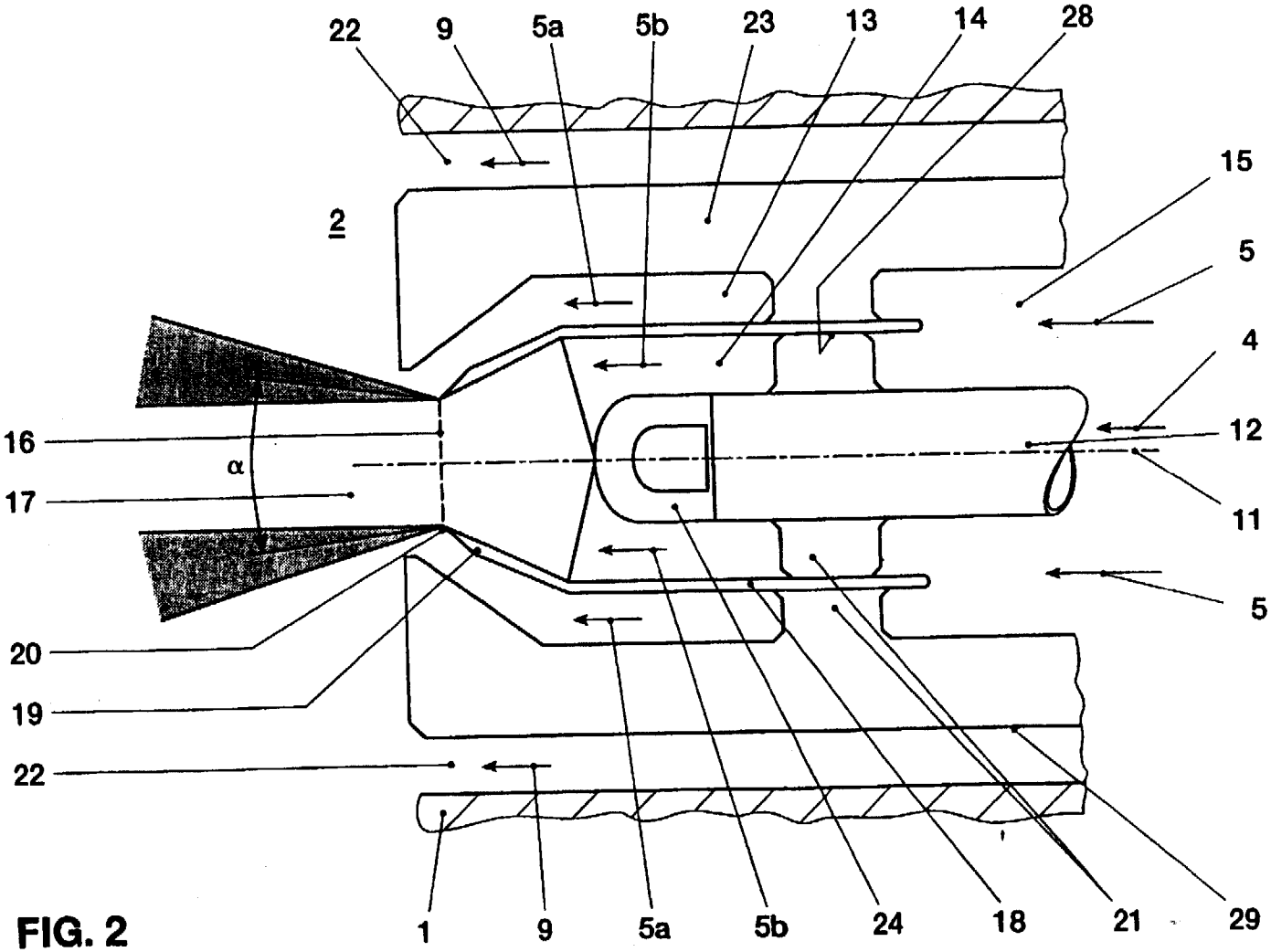
FIG. 2 shows a part longitudinal section through the airblast nozzle, with a conventional oil-pressure atomizer being used.

FIG. 2 shows the airblast nozzle 2 in an enlarged part longitudinal section. It has a fuel pipe 12, arranged round the nozzle axis 11, for the liquid fuel 4 and possesses an outer 13 and an inner 14 air duct which are arranged concentrically thereto. The two air ducts 13, 14 are connected upstream to an air feed conduit 15, in which the atomizer air 5 is guided to the nozzle, and open into the burner interior 17 at the atomization cross section 16. The ducts 13, 14 are separated from one another by an intermediate wall 18 which, according to the invention, is angled frustoconically at its downstream end in the direction of the nozzle axis 11 and there forms the atomizer edge 19 with the atomizer lip 20, so that the atomizer air 5 is divided into an outer 5*a* and an inner 5*b* air stream. By means of inner and outer support elements 21 arranged preferably at uniform intervals over the circumference, the intermediate wall 18, including the atomizer edge 19, is held between the fuel pipe 12 and nozzle outer body 23. In this case, the inner support elements 21 are arranged between the fuel pipe 12 and the intermediate wall 18, whilst the outer support elements 21 are arranged between the intermediate wall 18 and the nozzle outer body 23. In the present exemplary embodiment, a pilot gas duct 22 is provided in the burner 1, said pilot gas duct providing pilot gas 9 which serves for enriching the gaseous fuel 6 in the burner interior, thereby widening the stability range of the burner. According to FIG. 2, the pilot gas duct 22 is bounded by the nozzle outer body 23 and by the wall of the burner 1. The connection of the nozzle 2 to the burner 1 and the feed of the pilot gas duct 22 are not shown in FIG. 2. Said pilot gas duct can be implemented, for example, by means of a feed bore, not shown here, arranged in the burner wall and intended for the pilot gas. The nozzle 2 can be connected, for example, via a cover, not shown, which is welded over the entire circumference to the nozzle outer body 23 and to the wall of the burner 1 at the upstream end of the pilot gas duct 22 and which closes off the pilot gas duct 22. In other exemplary embodiments, of course, the arrangement of a pilot gas duct can also be dispensed with.

The liquid fuel 4, preferably oil, is applied as a thin film to the atomizer edge 19 via an exchangeable, commercially available pressure atomizer 24. Hollow-cone atomizers are optimal, but solid-cone atomizers with a well atomized fuel core can also be used. According to the invention, an outer profile of the atomizer edge 19 is tapered or narrowed inward, in order to obtain maximum air velocity in the atomization cross section 16 or at the atomizer lip 20. The inner air stream 5*b* is guided by the frustoconically angled surface of the intermediate wall 18 to the atomizer lip 20. The outer air stream 5*a* delivered in the outer air duct 13 is delivered, likewise via the narrowing or tapered outer profile of the atomizer edge 19, to the atomizer lip 20 where the fuel film is finely atomized by means of the shear forces of the two air streams 5*a*, 5*b*. The high air velocity has a positive effect on an improved atomization quality.

At the same time, the spray angle $\alpha$ can be influenced by the division of the two mass air streams 5*a*, 5*b* and by geometry of the outlet cross section.

In the exemplary embodiment represented in FIG. 2, in the upper part of the figure the inner support elements 21 are not firmly connected to the intermediate wall 18, so that a sliding point 28 is present at this location. This allows a displacement of the liquid fuel pipe 12, including the oil-pressure atomizer 24, so that the thermal expansion of the fuel lance 3 can thereby be accommodated and the position of the atomizer edge 19 relative to the double cone burner 1 does not vary, this being a great advantage. This arrangement necessitates merely a somewhat longer atomiser sleeve (=intermediate wall 18). Moreover, this version additionally avoids the need for problematic sealing between the pilot gas duct 22 and the atomizer in the burner 1, since the outer atomizer part would be an integral part of the burner 1. A further advantage is that, during the assembly of the fuel lance 3, the sensitive atomizer part remains in the double cone burner 1 and is therefore not damaged.

As a further embodiment which is illustrated in the lower part of FIG. 2, it is also possible to leave the atomizer as a whole, that is to say both the inner and the outer support elements 21 are connected firmly to the intermediate wall 18 as well as the liquid fuel pipe 12 and the nozzle outer body 23. The nozzle 2 is then displaceable as a whole from outside only (sliding point 29).

Figure 3:
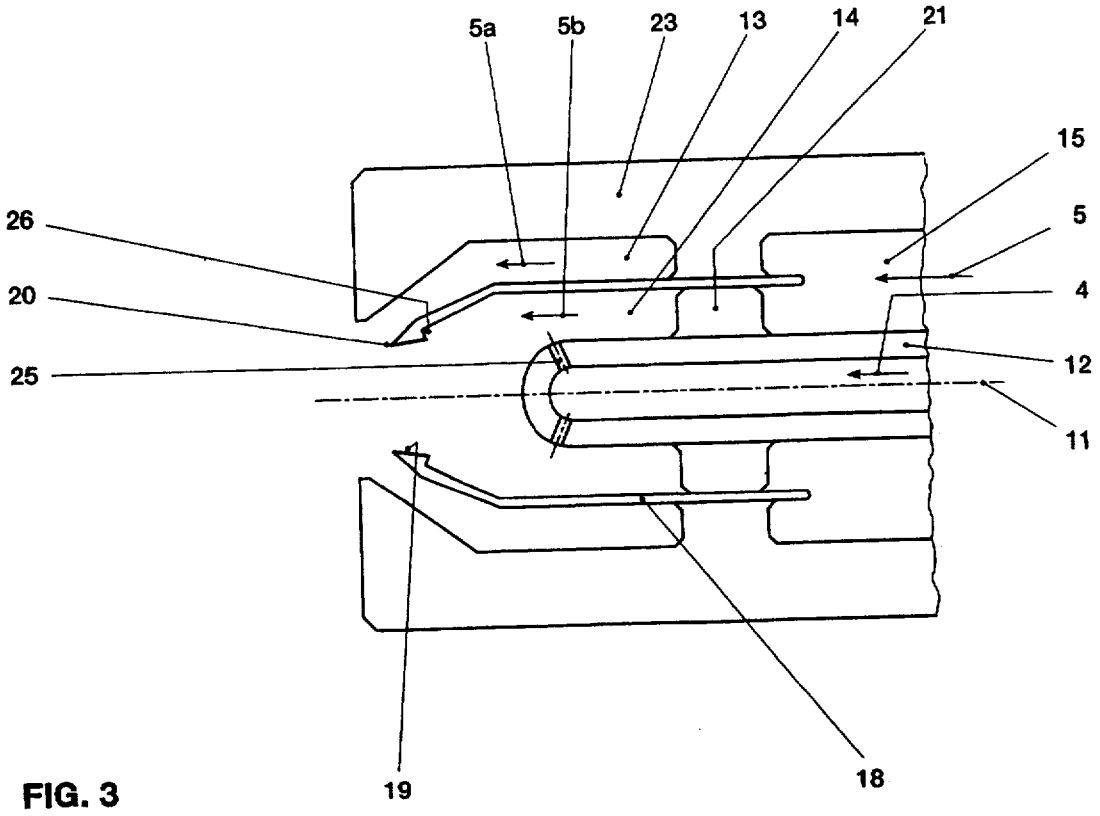
FIG. 3 shows a part longitudinal section through the airblast nozzle, in which a liquid fuel conduit having bores arranged obliquely relative to the nozzle axis of the closed end is used.

FIG. 3 shows a design variant in which the liquid fuel 4 is applied to the atomizer edge 19 via simple bores 25. These are arranged radially or obliquely at the closed end of the liquid fuel conduit 12. For the purpose of equalizing the fuel film and thereby improving the atomization quality, weirs 26 can be arranged in the atomization edge 19.

Figure 4:
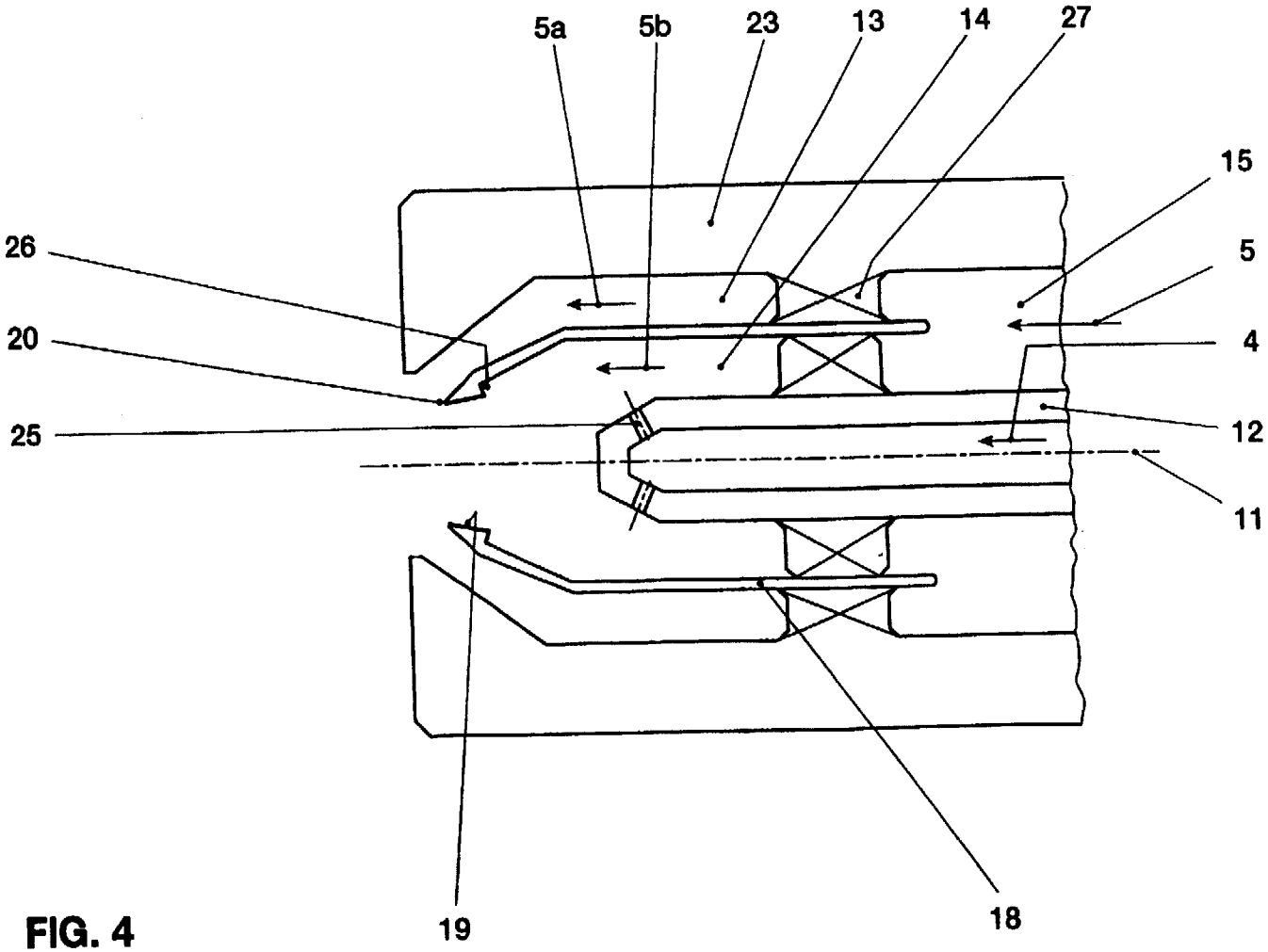
FIG. 4 shows a part longitudinal section through the airblast nozzle with support elements designed as swirl vanes and with a weir.

A further design variant is represented in FIG. 4. Here, in contrast to FIG. 3, the support elements 21 are designed as swirl vanes 27. It is also possible to arrange only the inner support elements 21 as swirl vanes, so that only the inner air stream 5b is swirled, in order to achieve a better flow around the atomizer lip 20. If only the outer air stream 5a is swirled, the spray angle α can thereby be influenced. Of course, as is evident from FIG. 4, both air streams 5a, 5b can also be swirled by designing both the inner and the outer support elements 21 as swirl generators.

Figure 6:
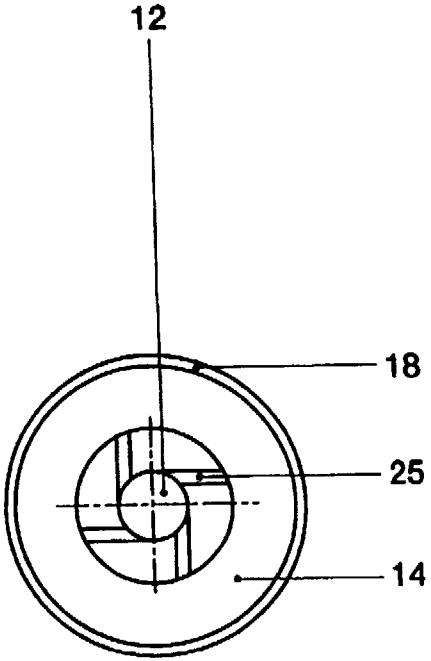
FIG. 6 shows a part cross section along the line VI—VI in FIG. 5.
Figure 5:
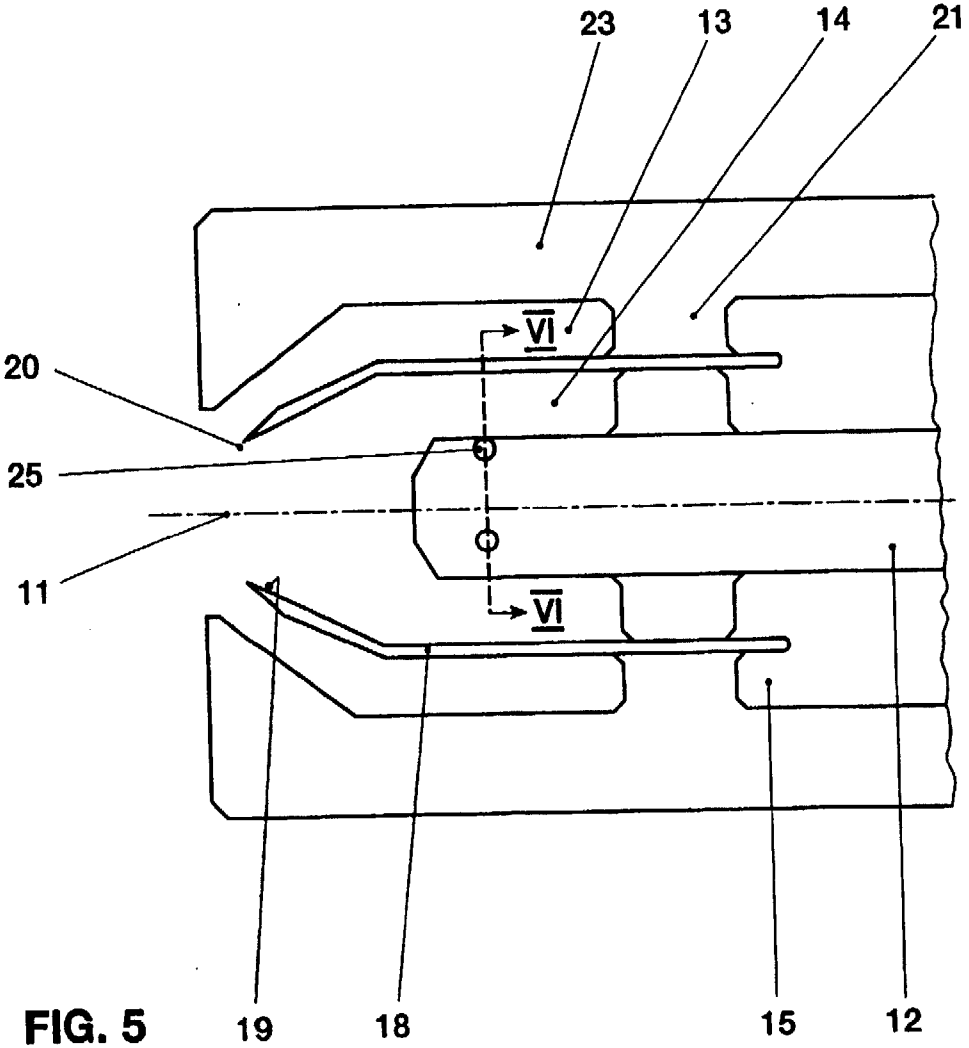
FIG. 5 shows a part longitudinal section through the airblast nozzle with a swirled application of liquid fuel.

FIGS. 5 and 6 illustrate an alternative embodiment for swirled injection of fuel from the liquid fuel conduit 12. In this case, the bores 25 in the fuel conduit 12 are eccentric to the fuel conduit center axis 11, as may be seen FIG. 6, which causes the fuel to swirl as it flows into the inner duct 14.

Figure 7:
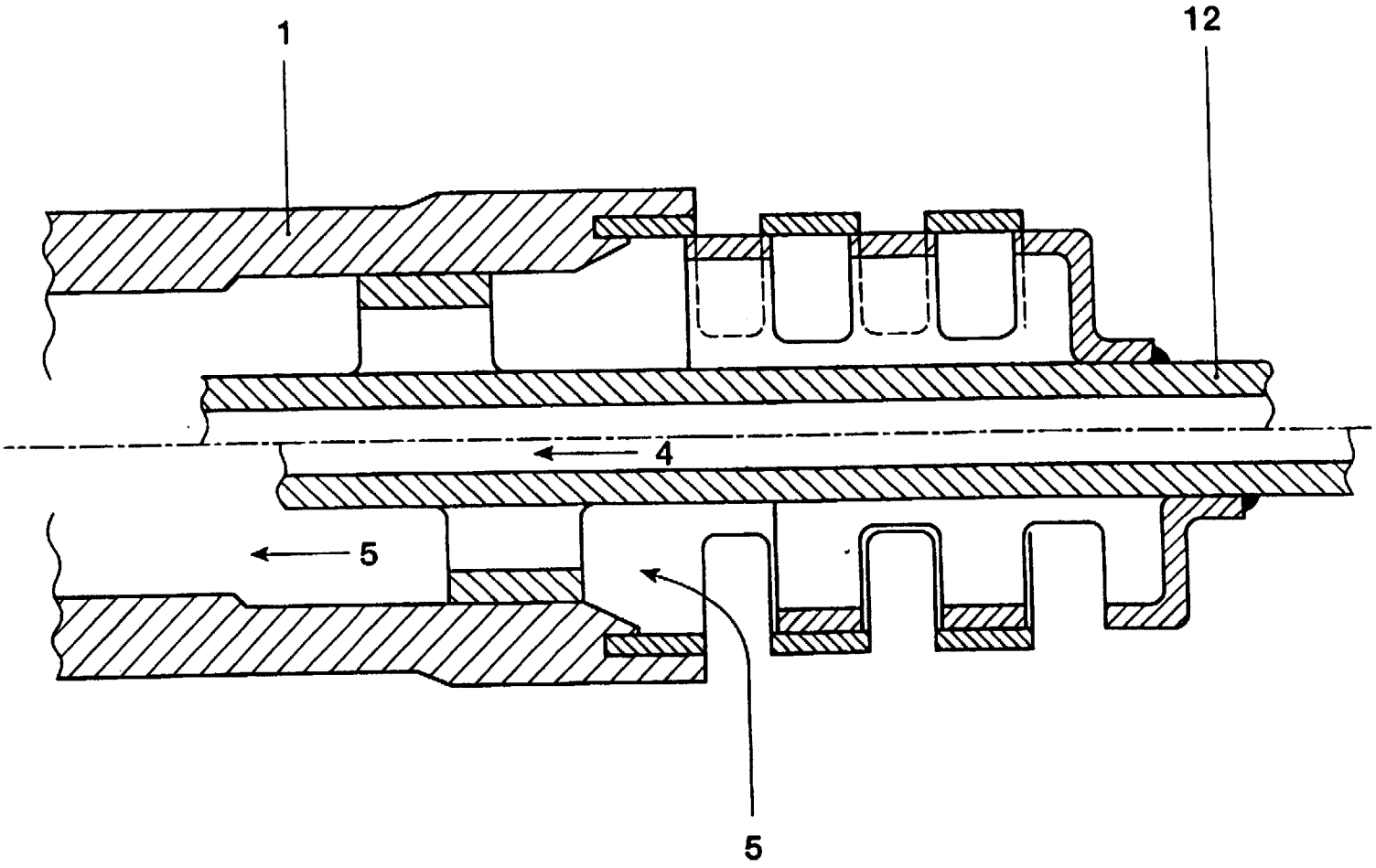
FIG. 7 shows a part longitudinal section through the burner part and the fuel feed, gas operation being illustrated in the upper part figure and oil operation being illustrated in the lower part figure.

Since the gas operation of the double cone burner 1 is disturbed as a result of the atomizer air 5 flowing through the airblast nozzle 2, to solve this problem there is proposed, according to FIG. 7, a mechanism which utilizes the different thermal expansion of the fuel conduit 12 during oil operation and gas operation. The upper part of FIG. 7 relates to gas operation, whereas the lower part relates to oil operation. The airblast nozzle 2 at the downstream end of the oil conduit 12 is not shown in FIG. 7. During gas operation, the atomizer air 5 is throttled, since the oil conduit 12 is heated by the air coming from the compressor and the inlet region of the atomizer air 5 into the burner part is correspondingly reduced or completely closed as a result of the thermal expansion of the oil conduit. In contrast to this, during oil operation or when water is added, the required atomizer air 5 is proportioned on account of the lower thermal expansion of the colder oil conduit 12 under these operating conditions (see the open inlet region for the air 5 in the lower part of FIG. 7). A precondition for this is that a liquid fuel conduit 12 is mounted firmly on the housing and the burner 1 is arranged firmly on the combustion chamber 10 not shown in FIG. 7.

Of course, in order to throttle the atomizer air 5 of the airblast nozzle according to the invention during gas operation, it is also possible to employ other already known throttle mechanisms, such as, for example, the throttling of the air 5 by displacement by means of pilot gas 9.

It may be stated, in conclusion, that the airblast nozzle according to the invention is distinguished by the following properties:

- compact design with minimal diameter
- minor pressure loss in the nozzle
- design-based pressure drop at the atomizer lip
- no components at the nozzle outlet which tend to deposition or overheating
- narrow spray angle α
- simple calibratability and exchangeability of the critical oil cross sections.

Obviously, numerous modifications and variations of the present invention are possible in light of the above teachings. It is therefore to be understood that, within the scope of the appended claims, the invention may be practised otherwise than as specifically described herein.

What is claimed as new and desired to be secured by Letters Patent of the United States is:

1. A method for operating a burner with liquid and gaseous fuel, the burner having an airblast nozzle including a nozzle outer body mounted to the burner and defining an air feed conduit having a nozzle axis, an intermediate wall disposed in a downstream portion of the air feed conduit to define an inner air duct and an outer air duct, a downstream portion of the intermediate wall forming an atomizer edge, an outlet of the atomizer edge defining an atomization plane, the atomizer edge having a frustoconical shaped narrowing toward the outlet, wherein, the inner air duct and outer air duct are positioned concentrically about the nozzle axis, the air ducts open into a burner interior at the atomization plane, and wherein a cross section of the outer air duct narrows upstream of the atomization plane, a liquid fuel pipe disposed centrally on the nozzle axis and having means for applying liquid fuel to the atomizer edge, said means located at a downstream end of the liquid fuel pipe, inner and outer support elements fixedly supporting the intermediate wall between the inner and outer air duct, the inner support elements being arranged between the intermediate wall and the fuel pipe and the outer support elements being arranged between the intermediate wall and the nozzle outer body, and a pilot gas duct arranged radially outward of and concentrically to the liquid fuel duct, the burner being mounted firmly on a combustion chamber, and having air throttling means attached between the liquid fuel conduit and the burner at an inlet to the burner, the liquid fuel conduit being slidable relative to the burner, the method comprising the steps of:

closing a fuel supply to the liquid fuel conduit for operation of the burner with gaseous fuel; and throttling an inflow of air into the air feed conduit by guiding air into the air feed conduit past the liquid fuel conduit to heat the liquid fuel conduit, wherein different thermal expansion of the liquid fuel conduit and the burner causes the liquid fuel conduit to expand to close the air throttling means.

2. An airblast atomizer nozzle for a burner having liquid and gaseous fuel feeds, the nozzle comprising:

a nozzle outer body defining an air feed conduit having a nozzle axis;

an intermediate wall disposed in a downstream portion of the air feed conduit to define an inner air duct and an outer air duct, the intermediate wall having an upstream edge disposed in the air feed conduit to define inlets to the inner air duct and outer air duct, and having a frustoconically shaped downstream outlet portion narrowing to form an atomizer edge, an outlet of the atomizer edge defining an atomization plane, and an outer profile of the atomizer edge tapering toward the outlet, wherein, the inner air duct and outer air duct are positioned concentrically about the nozzle axis, the inner and outer air ducts opening into a burner interior at the atomization plane, and wherein a cross section of the outer air duct narrows upstream of the atomization plane, a liquid fuel pipe disposed centrally on the nozzle axis and extending into the intermediate wall, the liquid fuel pipe having means for spraying liquid fuel to the atomizer edge, said means located at a downstream end of the liquid fuel pipe, and inner and outer support elements supporting the intermediate wall between the inner and outer air duct, the inner support elements being arranged in the inner air duct between the intermediate wall and the fuel pipe and the outer support elements being arranged in the outer air duct between the intermediate wall and the nozzle outer body.

3. The airblast atomizer nozzle as claimed in claim 2, wherein the liquid fuel pipe axially displaceable relative to the nozzle outer body, and the nozzle outer body is fixedly mounted to the burner.

4. The airblast atomizer nozzle as claimed in claim 2, wherein the nozzle outer body is axially displaceable to the burner.

5. The airblast atomizer nozzle as claimed in claim 3, wherein a sliding point is provided between the inner support elements on the liquid fuel pipe and the intermediate wall between the inner and the outer air duct.

6. The airblast atomizer nozzle as claimed in claim 2, wherein the means for applying the liquid fuel is an oil-pressure atomizer.

7. The airblast atomizer nozzle as claimed in claim 6, wherein the oil-pressure atomizer is a hollow-cone atomizer.

8. The airblast atomizer nozzle as claimed in claim 6, wherein the oil-pressure atomizer is a solid-cone atomizer.

9. The airblast atomizer nozzle as claimed in claim 2, wherein the means for applying the liquid fuel are radially arranged bores at the downstream end of the fuel pipe.

10. The airblast atomizer nozzle as claimed in claim 9, further comprising weirs arranged at the atomizer edge.

11. The airblast atomizer nozzle as claimed in claim 2, wherein at least one of the outer support elements and inner support elements are shaped as swirl generators.

12. The airblast atomizer nozzle as claimed in claim 2, further comprising a pilot gas duct arranged radially outward of and concentrically with the liquid fuel pipe.

13. An airblast atomizer nozzle as claimed in claim 12, wherein the liquid fuel conduit is slidable relative to the burner, and further comprising air throttling means attached to an upstream end of the liquid fuel conduit and an inlet of the burner, said air throttling means being operable by relative sliding of the liquid fuel conduit to the burner to open and close the air feed conduit wherein in the case of operation with gaseous fuel the inflow of air into the burner interior flows past the liquid fuel conduit causing it to heat and said throttling means closes because of different thermal expansion of the liquid fuel pipe or and the burner.

14. The airblast atomizer nozzle as claimed in claim 2, wherein the means for applying the liquid fuel are obliquely arranged bores at the downstream end of the fuel pipe.

* * * * *